United States Patent [19]

Kao

[11] 4,258,782

[45] Mar. 31, 1981

[54] HEAT EXCHANGER HAVING LIQUID TURBULATOR

[75] Inventor: Stephen S. T. Kao, Racine, Wis.

[73] Assignee: Modine Manufacturing Company, Racine, Wis.

[21] Appl. No.: 52,867

[22] Filed: Jun. 28, 1979

[51] Int. Cl.[3] ..... F28F 1/40

[52] U.S. Cl. ..... 165/109 T; 138/38; 165/184; 366/338

[58] Field of Search ..... 138/38, 42, 44, 45; 165/109 T, 184, 156, 154, 155, 109 R; 366/337, 338, 339, 336

[56] References Cited

U.S. PATENT DOCUMENTS

| | | | |
|---|---|---|---|
| 242,300 | 5/1881 | Gold | 165/184 |
| 1,293,413 | 2/1919 | Gray | 165/156 |
| 1,880,533 | 10/1932 | Thomas | 165/154 |
| 1,932,610 | 10/1933 | Tilley | 165/184 |
| 2,234,423 | 3/1941 | Wittmann | 165/184 |
| 3,170,511 | 2/1965 | Guthrie | 165/184 |
| 3,362,058 | 1/1968 | Morris et al. | 165/184 |
| 3,519,070 | 7/1970 | Bappler | 165/184 |
| 4,085,491 | 4/1978 | Mathwig | 165/184 |
| 4,123,178 | 10/1978 | Salzman et al. | 366/338 |

FOREIGN PATENT DOCUMENTS

| | | | |
|---|---|---|---|
| 1592 | of 1858 | United Kingdom | 138/38 |
| 579610 | 8/1946 | United Kingdom | 165/184 |
| 318798 | 3/1972 | U.S.S.R. | 138/38 |

*Primary Examiner*—Sheldon J. Richter

*Attorney, Agent, or Firm*—Wegner, Stellman, McCord, Wiles & Wood

[57] ABSTRACT

A heat exchange device comprising a liquid flow tube with an inner cylinder located interiorly of the tube and a turbulator arranged generally helically around the cylinder with edgewise adjacent fins in the form of separate tongues in which each fin is at an angle of about 100°-110° from the inner cylinder on which the turbulator is located. This angle is measured from the cylinder in the direction of flow of the liquid flowing through the tube. Adjacent edges of adjacent fins describe a divergent V from the cylinder toward the tube and thereby describe channels between adjacent fins for directing the liquid outwardly toward the tube.

3 Claims, 5 Drawing Figures

HEAT EXCHANGER HAVING LIQUID TURBULATOR

SUMMARY OF THE INVENTION

One of the features of this invention is to provide a tubular heat exchange device comprising a liquid flow tube and an inner cylinder of a diameter smaller than the inner diameter of the tube and located therewithin with a turbulator arranged generally helically around the cylinder and having edgewise adjacent fins that are angled downstream from the cylinder with the fins being spaced apart to form channels for the flow of the liquid between the fins and toward the inner surface of the tube.

The most pertinent prior art of which I am aware are the following U.S. Pat. Nos. 1,833,876; 1,932,610; 1,961,744; 2,372,795; 2,852,042; 2,864,405; 2,870,999; 2,965,555; 3,887,004; 3,923,288 and 4,086,959.

DESCRIPTION OF THE PREFERRED EMBODIMENT

Figure 1:
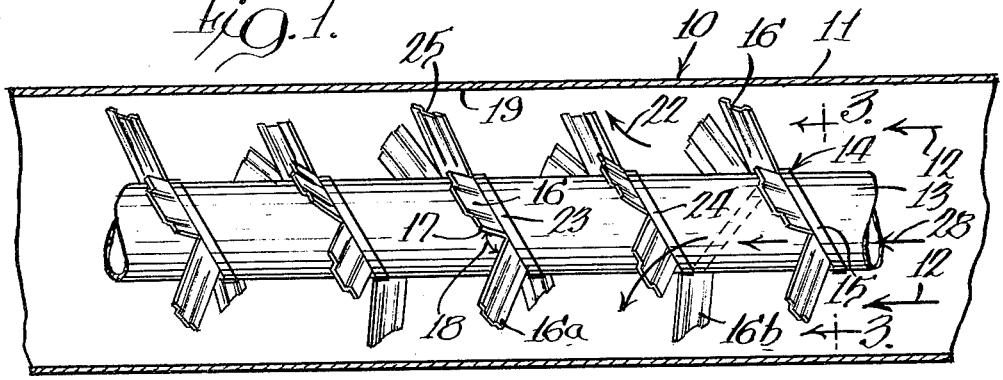
FIG. 1 is a fragmentary longitudinal sectional view through a heat transfer device according to this invention showing the liquid flow tube in longitudinal section and the inner cylinder and fins projecting therefrom in side elevation.
Figure 2:
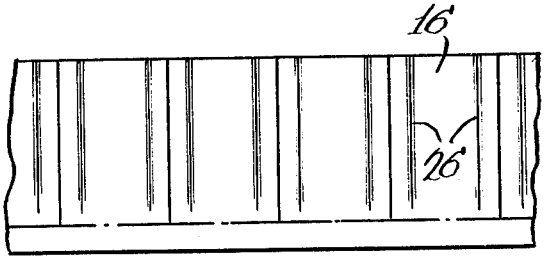
FIG. 2 is an enlarged side elevational view showing the turbulator before it is wound around the cylinder.
Figure 4:
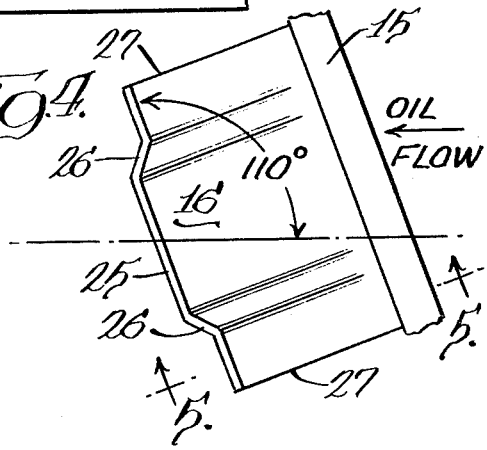
FIG. 4 is an enlarged sectional view taken substantially along line 4—4 of FIG. 3.

In the embodiment disclosed in the accompanying drawings there is illustrated a heat exchange device 10 that comprises an elongated tube 11 for a flowing liquid indicated by the arrows 12 and an inner cylinder 13 which may be a tube as shown or a solid rod having a cylindrical surface. This cylinder in the illustrated embodiment is located concentrically of the tube 11.

Arranged generally helically around the cylinder 13 is a turbulator 14 having a base flange 15 attached to the cylinder 13 and with edgewise adjacent fins 16 in the form of tongues projecting from the base flange 15 and thus from the cylinder 13 to which the flange is attached.

These fins which are spaced from each other except at their bases have adjacent edges 17 that describe a divergent V shaped channel 18 between adjacent fins 16. Each V 18 extends from the inner cylinder 13 toward the inner surface 19 of the tube 11 and thereby functions as a liquid flow channel for directing the liquid outwardly toward the tube as indicated by the liquid flow arrow 22 in FIG. 1.

Longitudinally adjacent fins **16*a* and 16*b* in successive reaches 23 and 24 of the helix of the turbulator 14 are spaced apart a distance equal to about 0.8–1.2 times the inner diameter of the liquid flow tube 11. Also, the outer tip edge 25 of each fin 16 is spaced from the inner surface 19** of the tube a distance equal to about 5 to 8% of the inner diameter of the tube.

Each fin or tongue is bent from its base flange 15 in a direction downstream to the direction of liquid flow 12. This bending is to an angle greater than 90° and is about 100°–110° from the inner cylinder 13 in the direction of flow 12.

Figure 3:
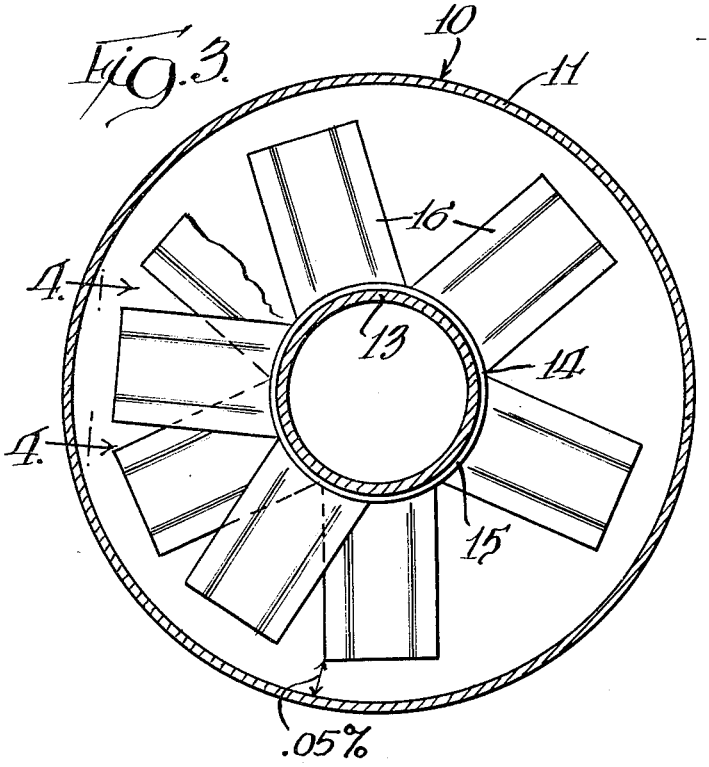
FIG. 3 is an enlarged sectional view taken substantially along line 3—3 of FIG. 1.
Figure 5:
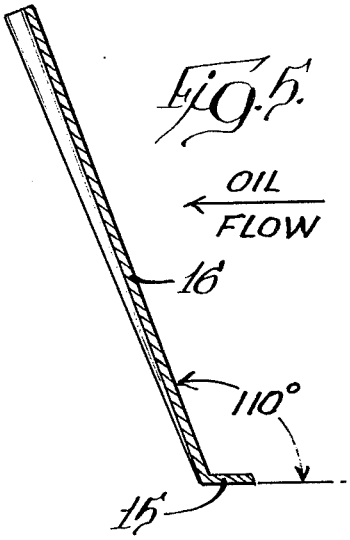
FIG. 5 is a sectional view through the turbulator and taken along line 5—5 of FIG. 4.

In the practical embodiment of the invention the spacing of each tip edge 25 from the inner surface 19 of the tube is about 5% of the inner diameter of the tube as indicated by the dimensional arrow at the bottom of FIG. 3. In the illustrated embodiment of the invention each 360° reach of the turbulator 14 contains six fins numbered 1–6 in FIG. 3 with the fins numbered 7 and 8 being the first two fins in the next 360° reach.

Longitudinally adjacent fins in successive reaches of 360° of the helix are spaced apart a distance equal to 0.8–1.2 times the inner diameter of the tube 11 with a practical spacing being about 1 times the inner diameter. In other words, in the illustration of FIG. 3 the fins 1 and 7 have this spacing, 2 and 8 have this spacing and the other successive fins have equal spacing.

In the illustrated embodiment each fin 16 is generally planar but formed with a radial channel 26 intermediate the radial edges 27. These channels strengthen the fins and also aid in directing the liquid 22 toward the inner surface of the surrounding tube.

In the illustrated embodiment the ratio of the square of the cylinder 13 to the square of the inner diameter of the tube 11 is about 0.04–0.03.

The device of this invention provides a turbulator that is especially useful for viscous liquids such as oil in a tubular heat exchanger. In the field of heat transfer particularly where a viscous liquid is involved the boundary layer between the liquid and the tube serves to limit the rate of heat transfer severely in extreme cases. This is particularly true when the solid member has a parting wall such as a metal wall separating two heat transfer liquids from each other.

In the past this boundary layer problem has been attacked by distorting the surface over which the viscous liquid flows to interrupt the surface and to break up the boundary layer to minimize its effect. These attempts have never been too successful.

In the present invention the turbulator with the described fins not only deflects the viscous liquid to the outer wall, which in this instance is the tube 11, but also tends to break up the boundary layer along each solid fin 16 as well as along the inner surface of the tube 11. The turbulator therefore directs the liquid in multiple directions. The flowing liquid wipes the surfaces of the fins 16 and the inner surface of the tube 11 both to improve heat transfer between the tube 11 and the fins 16 and the liquid and also to improve heat transfer generally by the resulting turbulence set up in the flowing liquid.

In addition, when the cylinder 10 is an inner tube as shown with another heat transfer liquid 28 flowing therethrough, the agitation of the liquid 12 as explained above improves the heat transfer through the inner tube and the fins 16 attached thereto.

Actual tests have shown that the results achieved with the turbulator of this invention are superior to those achieved with turbulators illustrated in the above prior art U.S. patents.

Having described my invention as related to the embodiment shown in the accompanying drawings, it is my intention that the invention be not limited by any of the details of description, unless otherwise specified, but rather be construed broadly within its spirit and scope as set out in the appended claims.

I claim:

1. A heat exchange device having a liquid turbulator, comprising: a liquid flow tube; an inner cylinder of a diameter smaller than the inner diameter of the tube and located within the tube; and a turbulator arranged generally helically around the cylinder and having edgewise adjacent fins in the form of separate tongues in which each fin is at an angle of about 100°–110° from the inner cylinder in the direction of flow of the liquid flowing through the tube, each said fin being generally planar but formed with a radial channel intermediate the radial edges of the fin, adjacent edges of adjacent fins describing a divergent V from the cylinder toward the tube thereby describing channels between adjacent fins for directing the liquid outwardly toward the tube, longitudinally adjacent fins in successive reaches of said helix being spaced apart a distance equal to 0.8–1.2 times the inner diameter of the tube, the outer tip edge of each fin being spaced from the inner surface of the tube a distance equal to about 5 to 8% of the inner diameter of the tube.

2. A heat exchange device having a liquid turbulator, comprising: a liquid flow tube; an inner cylinder of a diameter smaller than the inner diameter of the tube and located within the tube; and a turbulator arranged generally helically around the cylinder and having edgewise adjacent fins in the form of separate tongues in which each fin is at an angle of about 100°–110° from the inner cylinder in the direction of flow of the liquid flowing through the tube, longitudinally adjacent fins in successive reaches being spaced apart a distance equal to about the inner diameter of the tube and wherein each said fin is generally planar but formed with a radial channel intermediate the radial edges of the fin, adjacent edges of adjacent fins describing a divergent V from the cylinder toward the tube thereby describing channels between adjacent fins for directing the liquid outwardly toward the tube, the outer tip edge of each fin being spaced from the inner surface of the tube a distance equal to about 5 to 8% of the inner diameter of the tube.

3. A heat exchange device having a liquid turbulator, comprising: a liquid flow tube; an inner cylinder of a diameter smaller than the inner diameter of the tube and located within the tube; and a turbulator arranged generally helically around the cylinder and having edgewise adjacent fins in the form of separate tongues in which each fin is at an angle of about 100°–110° from the inner cylinder in the direction of flow of the liquid flowing through the tube, adjacent edges of adjacent fins describing a divergent V from the cylinder toward the tube thereby describing channels between adjacent fins for directing the liquid outwardly toward the tube, the outer tip of each fin being spaced from the inner surface of the tube a distance equal to about 5 to 8% of the inner diameter of the tube, each 360° reach of the turbulator containing six fins, longitudinally adjacent fins in successive reaches being spaced apart a distance equal to about the inner diameter of the tube and each said fin being generally planar but formed with a radial channel intermediate the radial edges of the fin.

* * * * *